United States Patent [19]

Stewart

[11] Patent Number: 4,760,309

[45] Date of Patent: Jul. 26, 1988

[54] MODULATOR ELECTRODE STRUCTURE FOR FLAT PANEL DISPLAY DEVICES

[75] Inventor: Wilber C. Stewart, Hightstown, N.J.

[73] Assignee: RCA Licensing Corporation, Princeton, N.J.

[21] Appl. No.: 479,983

[22] Filed: Mar. 29, 1983

[51] Int. Cl.[4] ..... H01J 29/52

[52] U.S. Cl. ..... 313/422; 313/411

[58] Field of Search ..... 313/422, 477 R, 495, 313/460, 411, 479

[56] References Cited

U.S. PATENT DOCUMENTS 4,128,784 12/1978 Anderson ..... 313/422

4,199,705 4/1980 Anderson et al. ..... 313/422

4,217,519 8/1980 Catanese et al. ..... 313/422 X 4,316,118 2/1982 Anderson et al. ..... 313/422

*Primary Examiner*—David K. Moore

*Assistant Examiner*—K. Wieder

*Attorney, Agent, or Firm*—E. M. Whitacre; D. H. Irlbeck; L. L. Hallacher

[57] ABSTRACT

A modulator structure includes modulation electrodes electrically coupled into pairs. Isolation electrodes are arranged adjacent to and in the plane of the modulation electrodes. The modulation electrodes are substantially U-shaped, and the isolation electrodes partially extend into the U.

5 Claims, 3 Drawing Sheets

MODULATOR ELECTRODE STRUCTURE FOR FLAT PANEL DISPLAY DEVICES

BACKGROUND OF THE INVENTION

This invention relates generally to flat panel display devices and particularly to a modulator electrode structure for such devices.

Prior art flat panel display devices, such as those described in U.S. Pat. Nos. 4,316,118 and 4,199,705, include a baseplate and a faceplate which are held in a spaced parallel relationship by a plurality of external side walls. A phosphor screen is arranged on the faceplate to produce the desired image when struck by electrons. The envelope is divided into a plurality of channels by internal walls which provide support against collapse due to atmospheric pressure. Each of the channels includes a guide mesh structure along which electron beams propagate the lengths of the channels until one line of the visual display is to be produced. The electrons are emitted from a cathode which is arranged at the entrance to each guide mesh structure. Pairs of modulation electrodes overlap the cathodes so that each electron beam can be individually modulated to produce the desired image on the screen. Interaction of the modulation voltages on adjacent pairs of modulation electrodes is avoided by the use of isolation electrodes between the modulation electrodes. The isolation electrodes are all biased at the same constant voltage. The constant electric field produced by the isolation electrodes prevent the varying electric fields of the modulation voltages from interacting and adversely affecting the modulation of the electron beams.

Flat panel display devices built in accordance with the prior art operate satisfactorily for the purposes intended. However, the emission current density along the cathode between each modulator electrode pair is peaked in the center of the electrode and falls off sharply on each side. A less sharply peaked current distribution would result in the same total beam current being obtained with a smaller value of peak current and would constitute a very desirable improvement.

The instant invention provides this improvement by the provision of a modulator electrode configuration which substantially flattens the current distribution while maintaining the desired value of total beam current.

SUMMARY OF THE INVENTION

A flat panel display device includes at least one electron beam guide assembly and a cathode for emitting electrons to the beam guide assembly. Modulation electrodes are used to modulate the electron beams and isolation electrodes are arranged between the modulation electrodes. A slit is arranged along a portion of the length of the modulation electrodes and a portion of the isolation electrodes extend into the slit.

DETAILED DESCRIPTION OF THE PREFERRED EMBODIMENT

Figure 1:
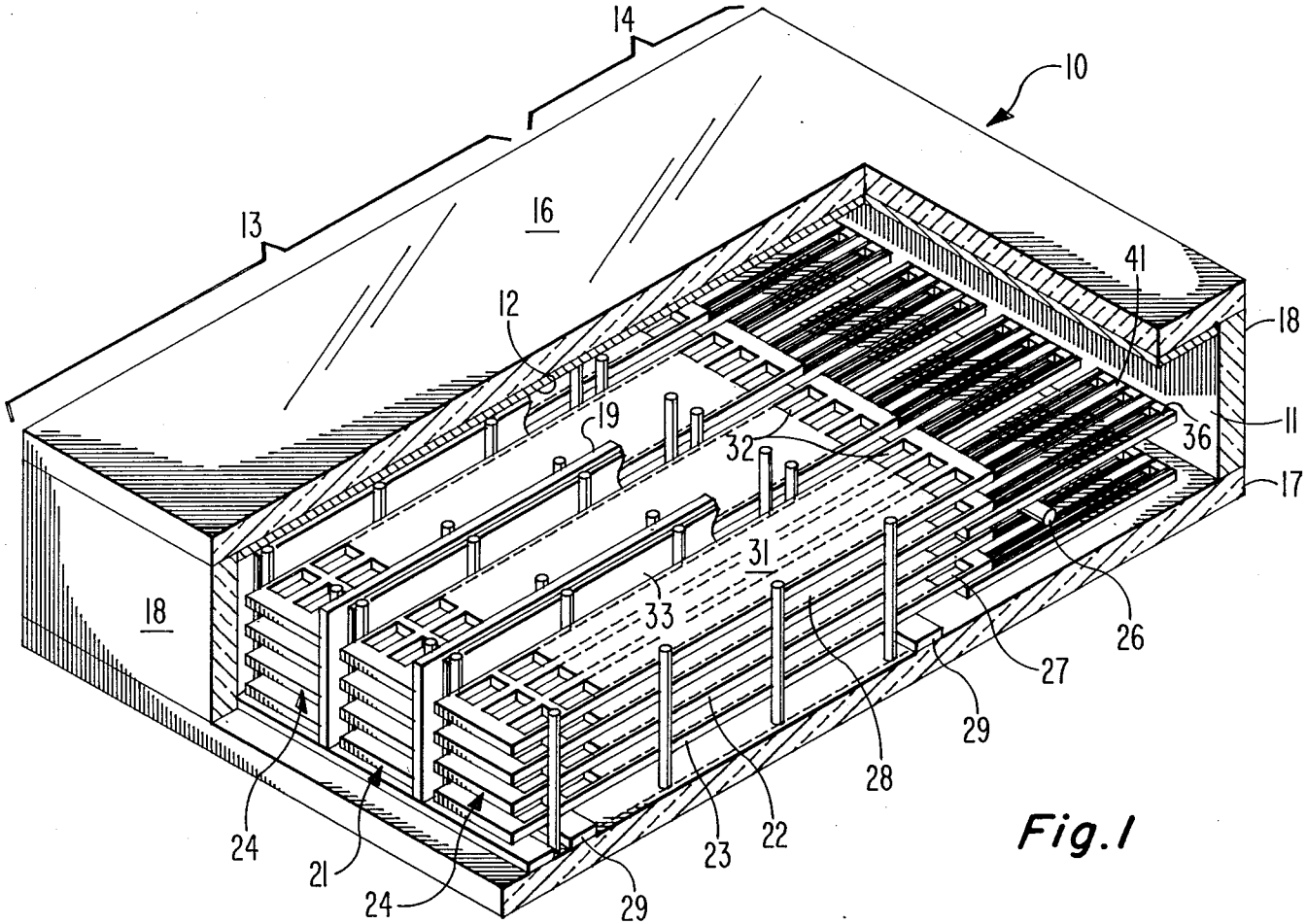
FIG. 1 is an isometric view, partially broken away, of a flat panel display device incorporating the preferred embodiment.

FIG. 1 shows a flat panel display device 10 incorporating the preferred embodiment. The display device 10 includes an evacuated envelope 11 having a display section 13 and an electron gun section 14. The envelope 11 includes a frontwall 16 and a baseplate 17 held in a spaced parallel relationship by sidewalls 18. A display screen 12 is positioned along the frontwall 16 and gives a visual output when struck by electrons.

A plurality of spaced parallel support vanes 19 are arranged between the frontwall 16 and the baseplate 17. The support vanes 19 provide the desired internal support against external atmospheric pressure and divide the envelope 11 into a plurality of channels 21. Each of the channels 21 encloses a pair of spaced parallel beam guide meshes 22 and 23 extending transversely, or horizontally, across the channels and longitudinally, or vertically, along the channels from the gun section 14 to the opposite sidewall 18. A cathode 26 is arranged to emit electrons into the spaces 24 between the guide mesh pairs of each channel. An individual cathode can be used for each electron beam of the device, a number of cathodes can be used to provide the electrons needed for several beams, or a single line cathode can be used to produce the electrons for all the beams. The guide meshes 22 and 23 include apertures 27 which are arranged in columns longitudinally along the channels 21 and in rows transversely across the channels when three electron beams are used. A focus mesh 28 is spaced above the upper guide mesh 22 in a parallel relationship therewith. A plurality of extraction electrodes 29 are arranged along the baseplate 17 to extend transversely across the channels 21 the full width of the display device 10. The extraction electrodes 29 are arranged directly beneath the rows of apertures 27 in the guide meshes 22 and 23. Appropriate biasing voltages are applied to the focus mesh 28 and the extraction electrodes 29 to cause the electrons emitted from the cathode 26 to propagate between the guide meshes 22 and 23 in the spaces 24 for the full length of the channels.

An acceleration mesh 31 is arranged in a spaced parallel relation with the focus mesh 28 and contains a plurality of apertures 32 which also are aligned in columns longitudinally of the channels and in rows transversely of the channels. Scanning electrodes 33 are arranged on both sides of the support vanes 19 so that each vane supports a scanning electrode for two adjacent channels. Pairs of modulation electrodes 36, which are separated by pairs of isolation electrodes 41, overlap the cathode 26.

In operation, the cathode 26 emits electrons into the spaces 24 between the meshes 22 and 23. Modulation voltages are applied to the modulation electrodes 36 to cause the electron beams to produce the desired image on the screen 12. The isolation electrodes 41 are biased more negatively than the cathode 26 to prevent electron emission between the columns of apertures 27. Additionally, the isolation electrodes prevent the different modulation voltages on adjacent modulaton electrodes 36 from interacting. The electron beams propagate in the spaces 24 between the guide meshes 22 and 23 until the production of one horizontal line of the visual display requires the beams to be directed toward the screen 12. Extraction of the electron beams from the spaces between the guide meshes is effected by applying a negative voltage to one of the extraction electrodes 29. The negative voltage causes the electron beams to pass through the apertures 27 in the guide meshes and the apertures 32 in the acceleration mesh 31 and the focus mesh 28. The extracted electron beams are horizontally scanned across the channels 21 by the application of varying voltages, such as sawtooth waveforms, to the scanning electrodes 33 on the sides of the support vanes 19. Every channel therefore is horizontally scanned between the two support vanes 19 so that each channel contributes a portion of each horizontal line of the visual display on the faceplate 16.

Figure 2:
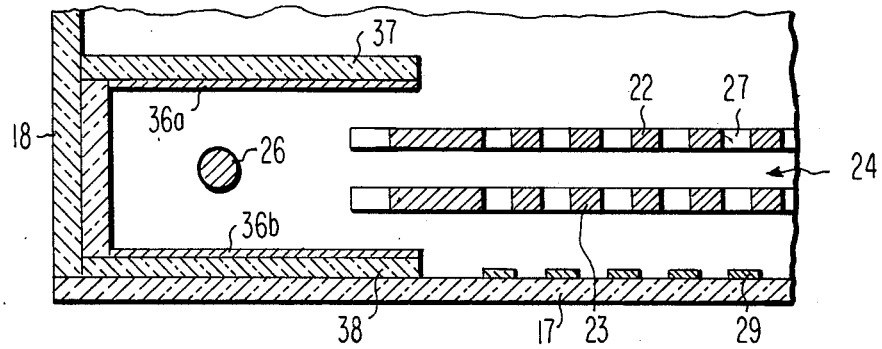
FIG. 2 is a cross-section view, partially broken away, of a preferred embodiment.

FIG. 2 is a cross-sectional view of the gun section 14 of the display device 10 of FIG. 1. The cathode 26 is arranged between an upper modulation electrode 36*a* and a lower modulation electrode 36*b*. The entrance to the space 24 between the guide meshes 22 and 23 is aligned with the cathode 26 and is positioned between the modulation electrodes 36*a* and 36*b*. The upper modulation electrode 36*a* is supported by an insulative support 37. Similarly, the lower modulation electrode 36*b* is supported by an insulative support 38. It should be noted that if desired, the support 39 can be omitted and the lower modulation electrode 36*b* arranged on the internal surface of the baseplate 17.

Figure 3:
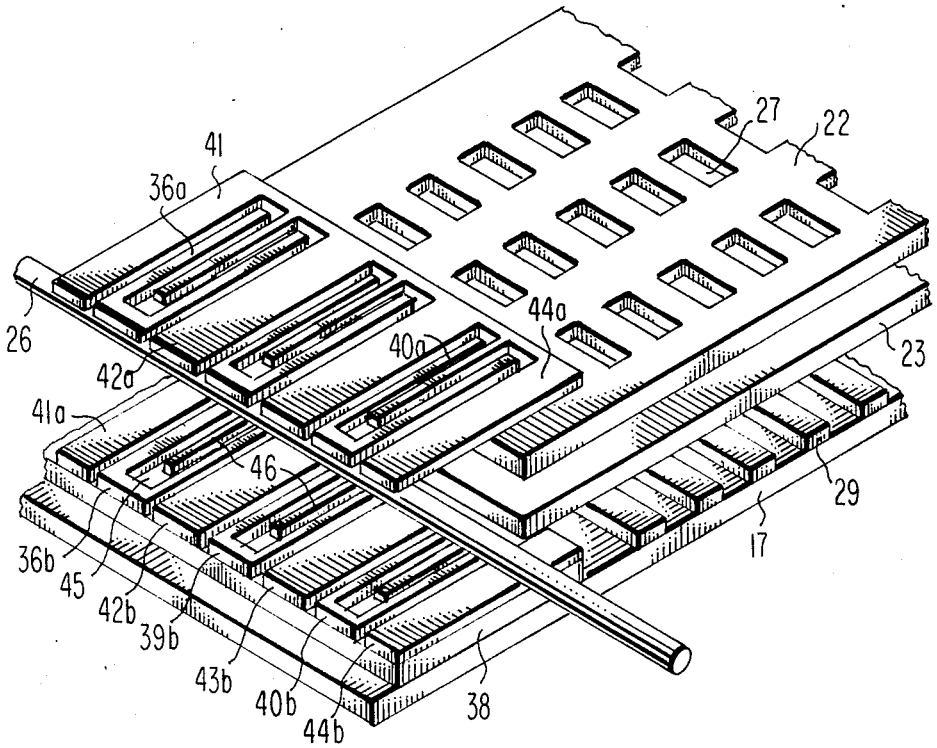
FIG. 3 is an isometric view, partially broken away, of the preferred embodiment of FIG. 2.
Figure 4:
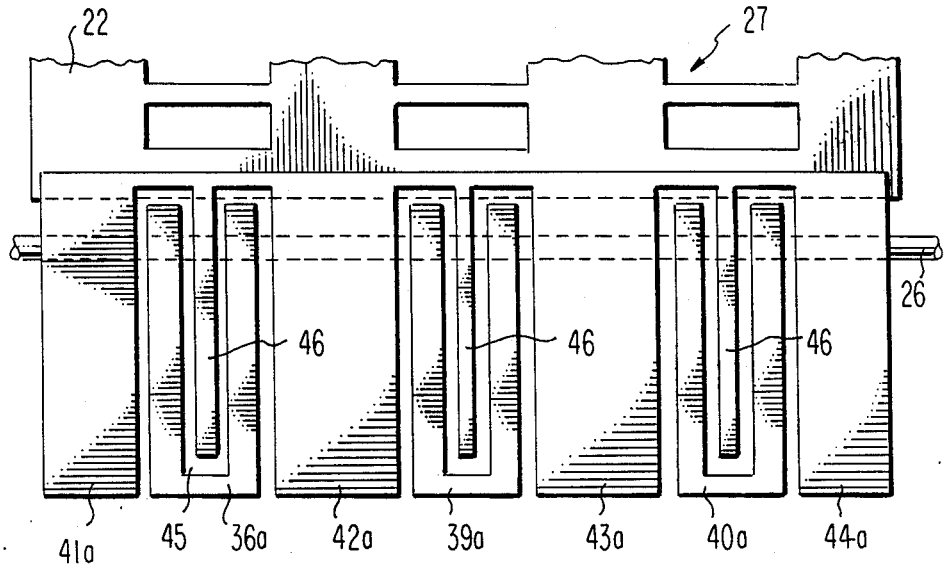
FIG. 4 is a top view of the preferred embodiment of FIG. 2.

FIG. 4 is a top view of the gun section of FIG. 2 with the support 37 removed. Three modulation electrodes 36*a*, 39*a* and 40*a* are arranged in alignment with columns of apertures 27 in the guide mesh 22. The modulation electrodes include a substantially centered slit 45 and, thus, are U-shaped with the opening of the slit 45 facing the apertures 27 in the guide mesh 22. A plurality of isolation electrodes 41*a*, 42*a*, 43*a* and 44*a* is arranged on both sides of the modulation electrodes. The isolation electrodes 41*a*–44*a* are electrically connected along the end in the proximity of the guide mesh 22. A portion 46 of the isolation electrodes extends into the slit 45 of each of the U-shaped modulation electrodes. As shown in FIG. 3, the modulation electrodes 36*a*, 39*a* and 40*a* have corresponding modulation electrodes 36*b*, 39*b* and 40*b* positioned on the lower support 38. Thus, the modulation electrodes are arranged in pairs which overlap the cathode. The modulation electrodes 36*b*, 39*b* and 40*b* also include a longitudinal slit. The support 38 also supports isolation electrodes 41*a* to 44*b*. The isolation electrodes, therefore, also are arranged in pairs which overlap the cathode 26.

The isolation electrodes 41*a*–44*a* are electrically connected whereby all the electrodes, and the portions 36 which extend into the slits 45 of the U-shaped modulation electrodes, can be biased at the same potential. Accordingly, the isolation electrodes are biased with a constant voltage and serve the dual purposes of isolating the modulation electrodes so that the modulation voltages do not interfere with one another. Additionally, the fixed voltage on the portions 46 which extend into the slits 45 causes a flattening of the current distribution of the electron pattern emitted from the cathode 26.

Figure 5:
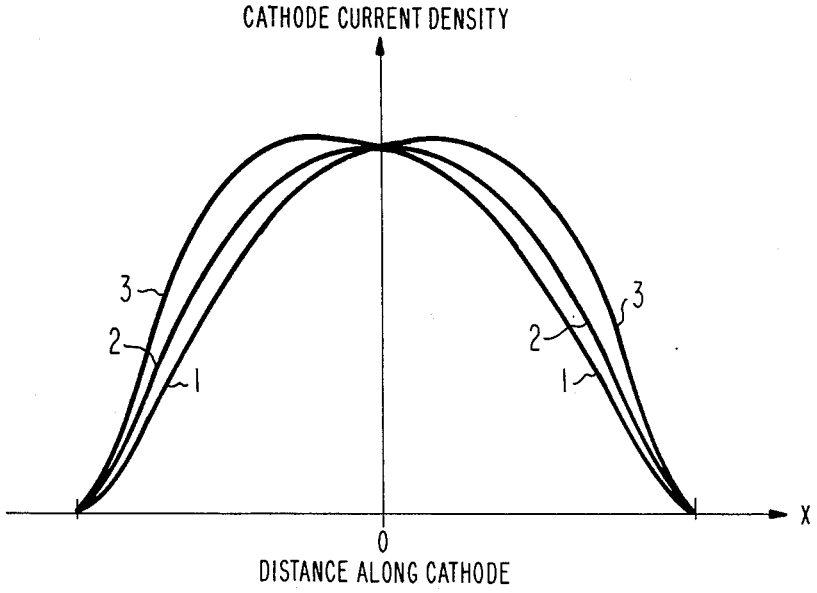
FIG. 5 shows the cathode current density distribution along the length of the cathode for several modulator electrode configurations.

In FIG. 5, the distribution of the cathode current density for beam guide structures of the types disclosed in the aforereferenced patents is identified as curve 1. This curve is peaked at the center of the cathode, and thus at the center of the channel 21 in which the cathode resides, and drops off sharply on both sides. Accordingly, because of the fast drop off, a particular desired total value of beam current requires a high peak current. Curve 2 shows a somewhat improved drop off from the peaked current when modifications are made in the modulator structure. Such modifications would include, for example, the use of wider modulation electrodes or a decrease in the separation of the modulation electrodes. However, even this drop off is quite rapid and, thus, a high total beam current requires a relatively high peak current. Curve 3 shows how the peak current distribution is flattened out to broaden the current distribution along the entire cathode length resulting in a higher total beam current while permitting a substantial reduction in the peak current at the center of the cathode. Curve 3 is the type of current distribution realized when the modulation and isolation electrodes are configured in accordance with the invention.

What is claimed is:

1. In a display device having an evacuated envelope with substantially parallel front and back walls, at least one electron beam guide assembly including at least one column of apertures, at least one cathode for emitting electrons to said beam guide assembly for propagation as beams along said column of apertures, modulation electrodes for modulating said electron beams and electrically coupled isolation electrodes arranged between said modulation electrodes; an improvement comprising:

a slit substantially centered in, and arranged along a portion of the length of each of said modulation electrodes, the opening of said slit being in the proximity of said electron beam guides; and a portion of said isolation electrodes extending along each of said modulation electrode slits.

2. In a modulator structure for modulating a cathode, said modulator structure including at least one pair of electrically coupled electrodes, the modulation electrodes of each pair being arranged in a spaced substantially parallel relationship, said cathode extending substantially parallel to the plane of said modulation electrodes, and isolation electrodes arranged adjacent to and in the plane of said modulation electrodes; an improvement wherein:

said modulation electrodes are substantially U-shaped, and said isolation electrodes partially extend into said U.

3. The improvement of claim 2 wherein said cathode is a line cathode arranged substantially perpendicular to the legs of said U.

4. The improvement of claim 3 wherein said modulation structure includes a plurality of pairs of modulation electrodes and isolation electrodes between both electrodes of adjacent pairs, and wherein said isolation electrodes are electrically coupled.

5. The improvement of claim 2 wherein said modulation structure includes a plurality of pairs of modulation electrodes and isolation electrodes between both electrodes of adjacent pairs, and wherein said isolation electrodes are electrically coupled.

* * * * *